US008556004B2

(12) United States Patent
Hartung et al.

(10) Patent No.: US 8,556,004 B2
(45) Date of Patent: Oct. 15, 2013

(54) BOTTOM PREVENTER FOR USE IN A DRILLING SYSTEM

(75) Inventors: Markus Hartung, Hünfeld (DE); Christof Kruse, Wenden (DE)

(73) Assignee: Longyear TM, Inc., South Jordan, UT (US)

( * ) Notice: Subject to any disclaimer, the term of this patent is extended or adjusted under 35 U.S.C. 154(b) by 318 days.

(21) Appl. No.: 12/959,649

(22) Filed: Dec. 3, 2010

(65) Prior Publication Data

US 2012/0138368 A1 Jun. 7, 2012

(51) Int. Cl.

| | |
|---|---|
| ***E21B 3/02*** | (2006.01) |
| ***E21B 17/18*** | (2006.01) |
| ***E21B 21/015*** | (2006.01) |
| ***E02D 7/28*** | (2006.01) |

(52) U.S. Cl.
USPC ..... 175/171; 175/214; 175/216; 166/89.1; 405/232

(58) Field of Classification Search
USPC ..... 175/171, 173, 84, 214, 215, 216; 166/88.1, 84.1, 90.1, 89.1; 405/232, 405/252.1; 285/121.2, 121.3, 123.1
See application file for complete search history.

(56) References Cited

U.S. PATENT DOCUMENTS

| | | | | |
|---|---|---|---|---|
| 1,910,634 | A * | 5/1933 | Pearce | 251/1.1 |
| 3,174,563 | A * | 3/1965 | Edblom et al. | 175/258 |
| 3,835,943 | A * | 9/1974 | Bray | 175/135 |
| 3,961,673 | A * | 6/1976 | Wolters et al. | 175/52 |
| 4,232,752 | A * | 11/1980 | Hauk et al. | 175/135 |
| 4,711,310 | A * | 12/1987 | Luen | 175/171 |
| 5,279,365 | A | 1/1994 | Yenulis et al. | |
| 5,662,181 | A | 9/1997 | Williams et al. | |
| 7,237,625 | B2 * | 7/2007 | Minshull et al. | 175/135 |
| 2008/0314640 | A1 | 12/2008 | Vandersnick et al. | |
| 2009/0101411 | A1 | 4/2009 | Hannegan et al. | |

FOREIGN PATENT DOCUMENTS

JP 09125858 A1 5/1997

OTHER PUBLICATIONS

International Search Report for International Application No. PCT/US2011/062244 (mailed Sep. 26, 2012).

* cited by examiner

*Primary Examiner* — Kenneth L Thompson
(74) *Attorney, Agent, or Firm* — Ballard Spahr LLP

(57) ABSTRACT

A conduit assembly for use in a drilling system that may include an upper section, an intermediate section and a lower section. The upper section may include a first seal. The first seal may include an opening that may be sized and configured to receive and form a seal with an inner drill string. The first seal may include one or more slits that may extend from an outer edge of the first seal to the opening of the first seal. The intermediate section may include an outlet for a flushing medium. The outlet may include a projection that may extend into a hollow interior of the intermediate section. The lower section may be sized and configured to be connected to and disconnected from a connecting portion of an outer drill string. The lower section may be sized and configured to be connected to and disconnected from the intermediate section.

36 Claims, 7 Drawing Sheets

BOTTOM PREVENTER FOR USE IN A DRILLING SYSTEM

BACKGROUND

1. Field of the Invention

The present invention generally relates to drilling systems and methods.

2. Background Technology

A cased drilling system may be used for drilling into a formation to form a borehole in the formation. The cased drilling system may include an inner drill string and an outer drill string. The inner drill string may include an inner drill bit and/or one or more drill rods, and the outer drill string may include an outer drill bit and/or one or more casings. For example, the inner drill string may include an inner drill bit that may be connected to a series of connected drill rods, and the outer drill string may include an outer drill bit that may be connected to a series of connected casings. The series of connected drill rods and the series of connected casings may be assembled section-by-section as the inner and outer drill strings move deeper into the formation.

The inner drill string and the outer drill string may be used independently to drill into the formation. In further detail, the inner drill string and/or the outer drill string may be used to drill into the formation until, for instance, the outer drill string reaches a desired depth in the formation. After the outer drill string has reached a desired depth into the formation, the outer drill string may remain in place, while the inner drill string drills farther into the formation. For example, the inner and/or outer drill strings may be used to drill into the formation through less stable ground that could risk a borehole collapse (e.g., disturbed ground, sand, soft clay, boulders or other less stable ground conditions that could be washed out when a flushing media is pumped into the borehole) and into more stable ground. After the outer drill string has reached a desired depth into the more stable ground (e.g., about one or two meters or other desired depth), the outer drill string may remain in place, while the inner drill string drills farther into the formation and/or past a leading end of the outer drill string. By extending through the less stable ground and into the more stable ground, the outer drill string may advantageously help reduce the risk of a collapse of the borehole.

When the outer drill string reaches the desired depth in the formation, the inner drill string and/or the outer drill string may be disconnected from a head, a top hammer, and/or other driving mechanism used to advance the drill strings into the formation. With the drill strings disconnected from the driving mechanism, a conduit (sometimes referred to as a "bottom preventer") may be connected to a trailing or upper portion of the outer drill string. In particular, a trailing or upper portion of the inner drill string may be inserted through a leading or lower portion of the conduit, through the conduit, and out a trailing or upper portion of the conduit. Then, the conduit may be connected to the trailing or upper portion of the outer drill string, and the inner drill string may be reconnected to the driving mechanism for use in drilling farther into the formation. The conduit may be sized and configured to be engaged by a clamp while the conduit is connected to the outer drill string, which may help prevent inadvertent loss of the outer drill string down the borehole.

As the inner drill string drills farther into the formation, portions of the inner drill string may enter into the trailing or upper portion of the conduit, pass through the conduit, exit the leading or lower portion of the conduit, and into the outer drill string. The conduit may include one or more seals configured to form a seal with the portions of the inner drill string passing through the conduit.

While the inner drill string and/or the outer drill string drill into the formation, a flushing medium (such as water, air or other flushing medium) may be flushed through the inner and outer drill strings, which may remove debris (e.g., portions of the formation and/or portions of the drill bits) from the borehole and the inner and outer drill strings. In further detail, the inner drill string and the outer drill string may be tubular. For example, the rods of the inner drill string and the casings of the outer drill string may be tubes. The flushing medium may be pumped into the trailing or upper portion of the inner drill string, down through the inner drill string, out a leading or lower portion of the inner drill string, into a lower portion of the borehole, into a gap formed between an inner surface of the outer drill string and the outer surface of the inner drill string, up through the gap between the outer and inner drill strings, and out one or more outlets. When both of the drill strings are connected to the driving mechanism, these one or more outlets may include one or more outlets formed in another conduit, such as a "top preventer." Alternatively, these one or more outlets may include one or more outlets formed in the "bottom preventer" when connected to the trailing or upper portion of the outer drill string. The bottom preventer's seal(s) may be formed above its outlet(s), which may help guide the flushing medium and the debris conveyed by the flushing medium out of the bottom preventer via the outlet(s). In some instances, the flushing medium and the debris may be under high pressure and/or may move at a high speed through the drill strings. In such instances, the bottom preventer may advantageously prevent the flushing medium and the debris from spewing violently and uncontrollably out of the borehole and, instead, may guide the flushing medium and the debris through the bottom preventer's outlet(s) and away from the drilling system. For example, one or more hoses may be connected to the bottom preventer's outlet(s) to guide the flushing medium and the debris away from the drilling system. Consequently, the bottom preventer may help avoid creating accidents, environmental hazards, and messes at job sites.

SUMMARY

One aspect is a conduit assembly for use in a drilling system that may include an upper section, an intermediate section and a first lower section. The upper section may include a first seal. The first seal may include an opening that may be sized and configured to receive and form a seal with an inner drill string. The intermediate section may include an outlet for a flushing medium. The first lower section may be sized and configured to be connected to and disconnected from the intermediate section. The first lower section may include a leading portion that may be sized and configured to be connected to and disconnected from a trailing portion of a first outer drill string.

Another aspect is a conduit assembly for use in a drilling system that may include an upper portion, an intermediate portion and a lower portion. The upper portion may include a first seal. The first seal may include an outer edge, an opening that may be sized and configured to receive and form a seal with an inner drill string, and at least one slit that may extend from the outer edge of the first seal to the opening of the first seal. The intermediate portion may include an outlet for a flushing medium. The lower portion may be sized and configured to be connected to and disconnected from a trailing portion of an outer drill string.

Yet another aspect is a conduit assembly for use in a drilling system that may include an upper portion, an intermediate portion and a lower portion. The upper portion may include a first seal. The first seal may include an opening that may be sized and configured to receive and form a seal with an inner drill string. The intermediate portion may include a hollow interior, an outer surface, an inner surface, and an outlet for a flushing medium. The outlet may include a projection that may extend into the hollow interior beyond the interior surface. The lower portion of the conduit assembly may be sized and configured to be connected to and disconnected from a trailing portion of an outer drill string.

For purposes of summarizing, some aspects, advantages and features of a few of the embodiments of the invention have been described in this summary. Some embodiments of the invention may include some or all of these summarized aspects, advantages and features. However, not necessarily all of (or any of) these summarized aspects, advantages or features will be embodied in any particular embodiment of the invention. Thus, none of these summarized aspects, advantages and features are essential. Some of these summarized aspects, advantages and features and other aspects, advantages and features may become more fully apparent from the following detailed description and the appended claims.

BRIEF DESCRIPTION OF THE DRAWINGS

The appended drawings contain figures of preferred embodiments to further clarify the above and other aspects, advantages and features. It will be appreciated that these drawings depict only preferred embodiments of the invention and are not intended to limit its scope. These preferred embodiments will be described and explained with additional specificity and detail through the use of the accompanying drawings in which.

DETAILED DESCRIPTION OF THE PREFERRED EMBODIMENTS

Figure 1:
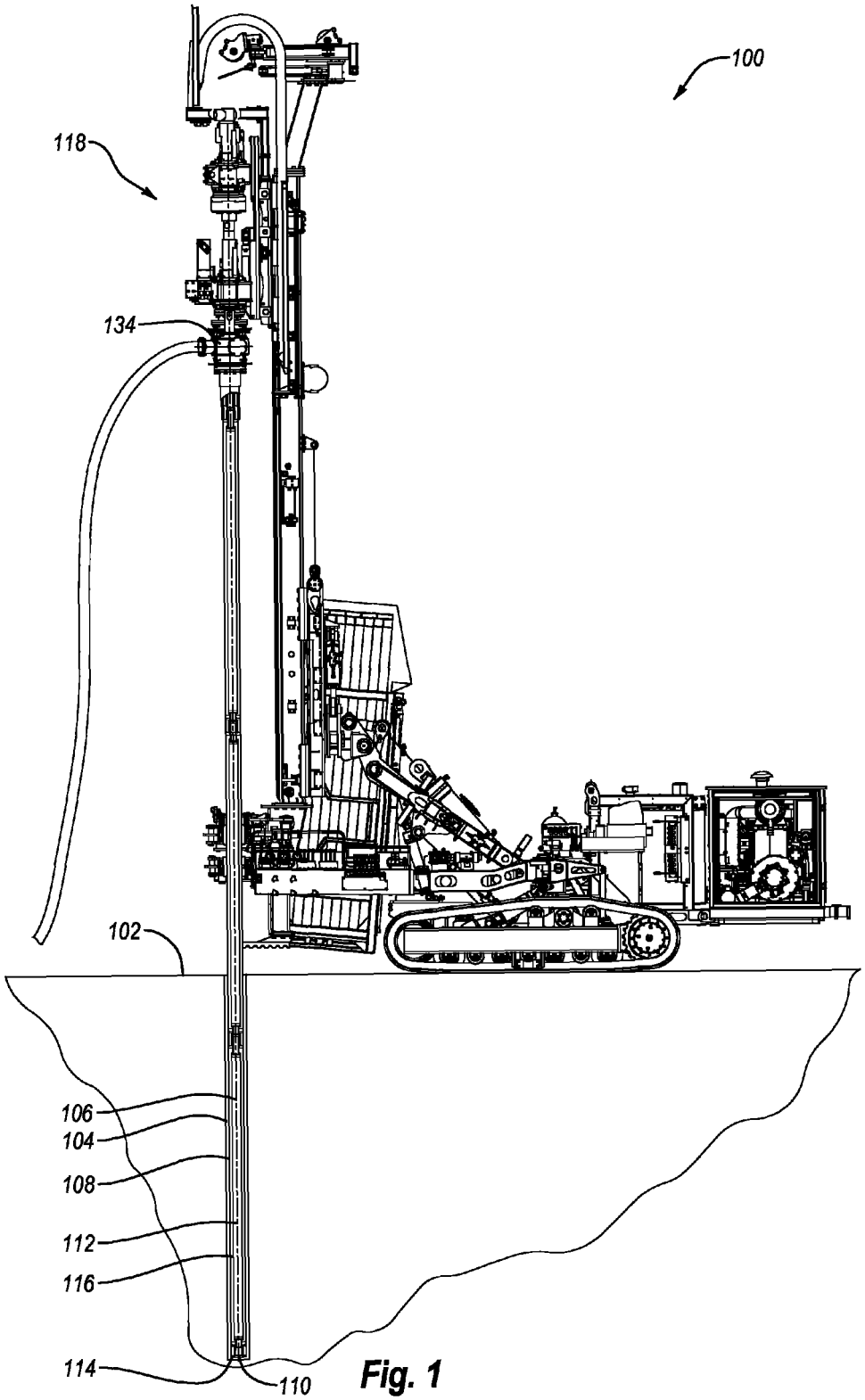
FIG. 1 is a diagram of an exemplary drilling system, illustrating an inner drill string and an outer drill string connected to a driving mechanism.

As shown in FIG. 1, a drilling system 100, such as a cased drilling system, may be used for drilling into a formation 102 to form a borehole 104 in the formation 102. The drilling system 100 may include an inner drill string 106 and an outer drill string 108. The inner drill string 106 may include an inner drill bit 110 and/or one or more drill rods 112, and the outer drill string 108 may include an outer drill bit 114 and/or one or more casings 116. For example, the inner drill string 106 may include the drill bit 110, which may be connected to a series of connected drill rods 112, and the outer drill string 108 may include the drill bit 114, which may be connected to a series of connected casings 116. The series of connected drill rods 112 and the series of connected casings 116 may be assembled section-by-section as the inner and outer drill strings 106, 108 move deeper into the formation 102.

The inner drill string 106 and the outer drill string 108 may be used independently to drill into the formation 102. In further detail, the inner drill string 106 and/or the outer drill string 108 may be used to drill into the formation 102 until, for instance, the outer drill string reaches a desired depth in the formation 102. After the outer drill string 108 has reached a desired depth into the formation 102, the outer drill string 108 may remain in place, while the inner drill string 106 drills farther into the formation. For example, the inner and outer drill strings 106, 108 may be used to drill into the formation 102 through less stable ground that could risk a borehole collapse and into more stable ground. After the outer drill string 108 has reached a desired depth into the more stable ground (e.g., about one or two meters or other desired depth), the outer drill string 108 may remain in place, while the inner drill string 106 drills farther into the formation and/or past a leading end of the outer drill string 108. By extending through the less stable ground and into the more stable ground, the outer drill string 108 may help advantageously reduce the risk of a collapse of the borehole 104.

Figure 2:
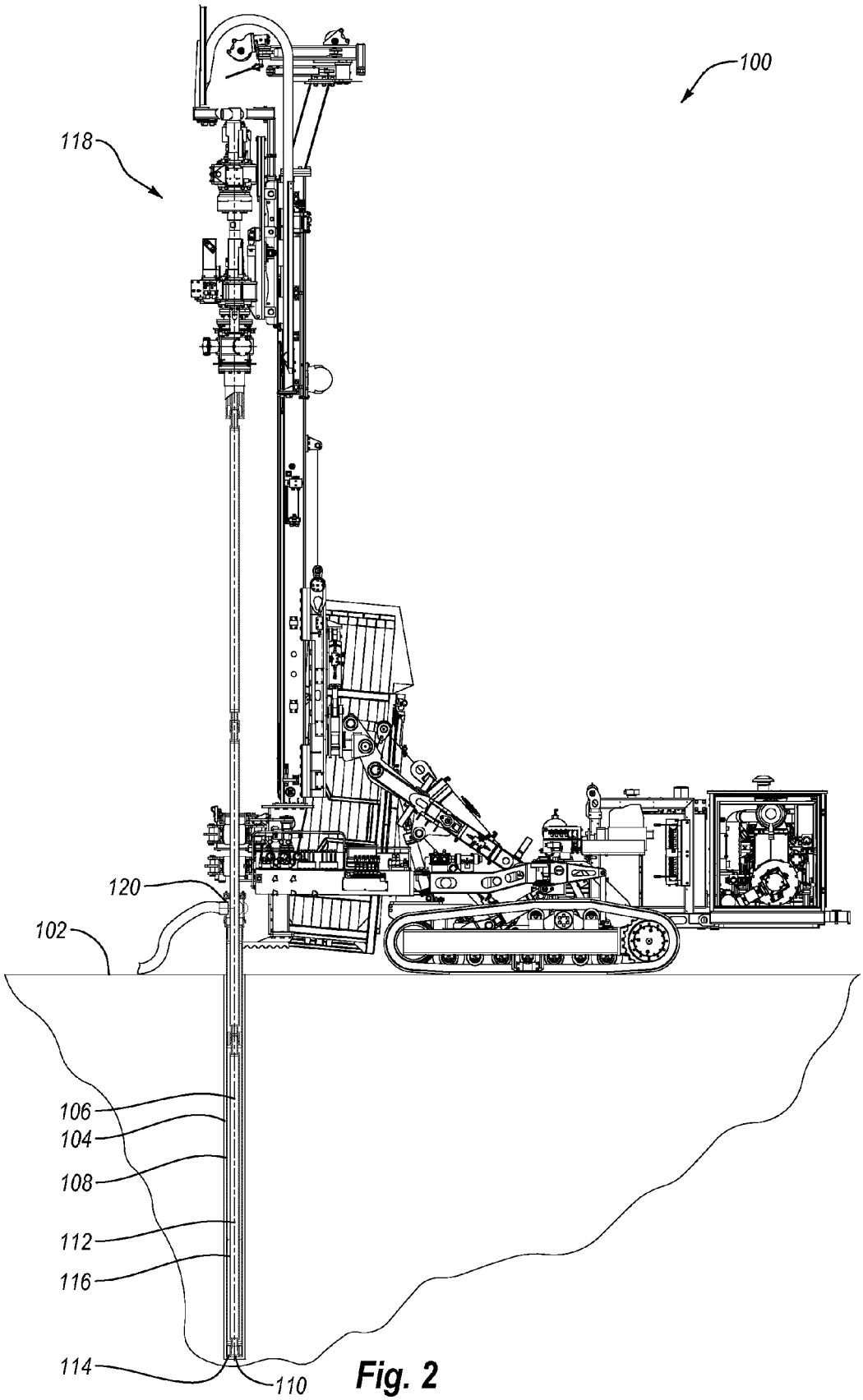
FIG. 2 is a diagram of the drilling system shown in FIG. 1, illustrating the inner drill string connected to a driving mechanism.

After the outer drill string 108 reaches the desired depth in the formation 102, the outer drill string 108 may drill further into the formation 102 until its trailing or upper portion is below a clamping device on a mast of the drilling system 100, and the inner drill string 106 and/or the outer drill string 108 may then be disconnected from a head, a top hammer, and/or other driving mechanism 118 used to advance the drill strings 106, 108 into the formation 102. With the drill strings 106, 108 disconnected from the driving mechanism 118, a conduit 120 shown in FIGS. 2-4 (sometimes referred to as a "bottom preventer") may be connected to the trailing or upper portion of the outer drill string 108. In particular, a trailing or upper portion of the inner drill string 106 may be inserted through a leading or lower section 122 of the conduit 120 shown in FIG. 5, through an intermediate section 123 of the conduit 120, and out a trailing or upper section 124 of the conduit 120. Then, the conduit 120 may be connected to the trailing or upper portion of the outer drill string 108 (for instance, to one or more threads of the trailing or upper portion of the outer drill string 108 as shown in FIG. 5), and the inner drill string 106 may be reconnected to the driving mechanism 118 for use in drilling farther into the formation 102. Accordingly, if desired, the inner drill string 106 may drill to a desired depth beyond the lower end and/or drill bit 114 of the outer drill string 108. The conduit 102 may be sized and configured to be engaged by a clamp while the conduit 120 is connected to the outer drill string 108, which may help prevent inadvertent loss of the outer drill string 108 down the borehole 104.

As the inner drill string 106 drills farther into the formation 102, portions of the inner drill string may, as shown in FIG. 5, enter into the upper section 124 of the conduit 120, pass through the intermediate section 123 of the conduit 120, exit the lower section 122 of the conduit 120, and into the outer drill string 108. The conduit 120 may include one or more seals 126 configured to form a seal with the portions of the inner drill string 106 passing through the conduit 120.

While the inner drill string 106 and/or the outer drill string 108 drill into the formation 102, a flushing medium (such as water, air or other flushing medium) may be flushed through the inner and outer drill strings 106, 108, which may remove debris (e.g., portions of the formation 102 and/or portions of the drill bits 110, 114) from the borehole 104 and the inner and outer drill strings 106, 108. In further detail, the inner drill string 106 and the outer drill string 108 may be tubular. For example, the drill rods 112 of the inner drill string 106 and the casings 116 of the outer drill string 108 may be tubes. The flushing medium may be pumped into the trailing or upper portion of the inner drill string 106, down through the inner drill string 106, out a leading or lower portion of the inner drill string 106, into a lower portion of the borehole 104, into a gap 128 formed between an inner surface 130 of the outer drill string 108 and an outer surface 132 of the inner drill string 106, up through the outer drill string 108 via the gap 128 between the outer and inner drill strings 106, 108, and out one or more outlets for a flushing medium. When both of the drill strings 106, 108 are connected to the driving mechanism 118 as shown in FIG. 1, these one or more outlets may include one or more outlets formed in a conduit 134 (sometimes referred to as a "top preventer"). Alternatively, these one or more outlets may include one or more outlets 136 formed in the conduit 120 when the conduit 120 is connected to the trailing or upper portion of the outer drill string 108, as shown in FIG. 5. The seals 126 of the conduit 120 may be formed above the outlets 136 of the conduit 120, which may help guide the flushing medium and the debris conveyed by the flushing medium out of the conduit 120 via the outlets 136.

As best seen in FIG. 5, the outlets 136 may include one or more projections 137 (such as tubes or other projections) that extend into an hollow interior of the intermediate section 123 beyond an interior surface of the intermediate section 123. Desirably, if these projections 137 extend into the hollow interior of the intermediate section 123 beyond an interior surface of the intermediate section 123, these projections 137 may break up portions of the flushing media and the debris to prevent clogging and allow the flushing media and the debris to more easily exit the outlets 136.

Figure 6:
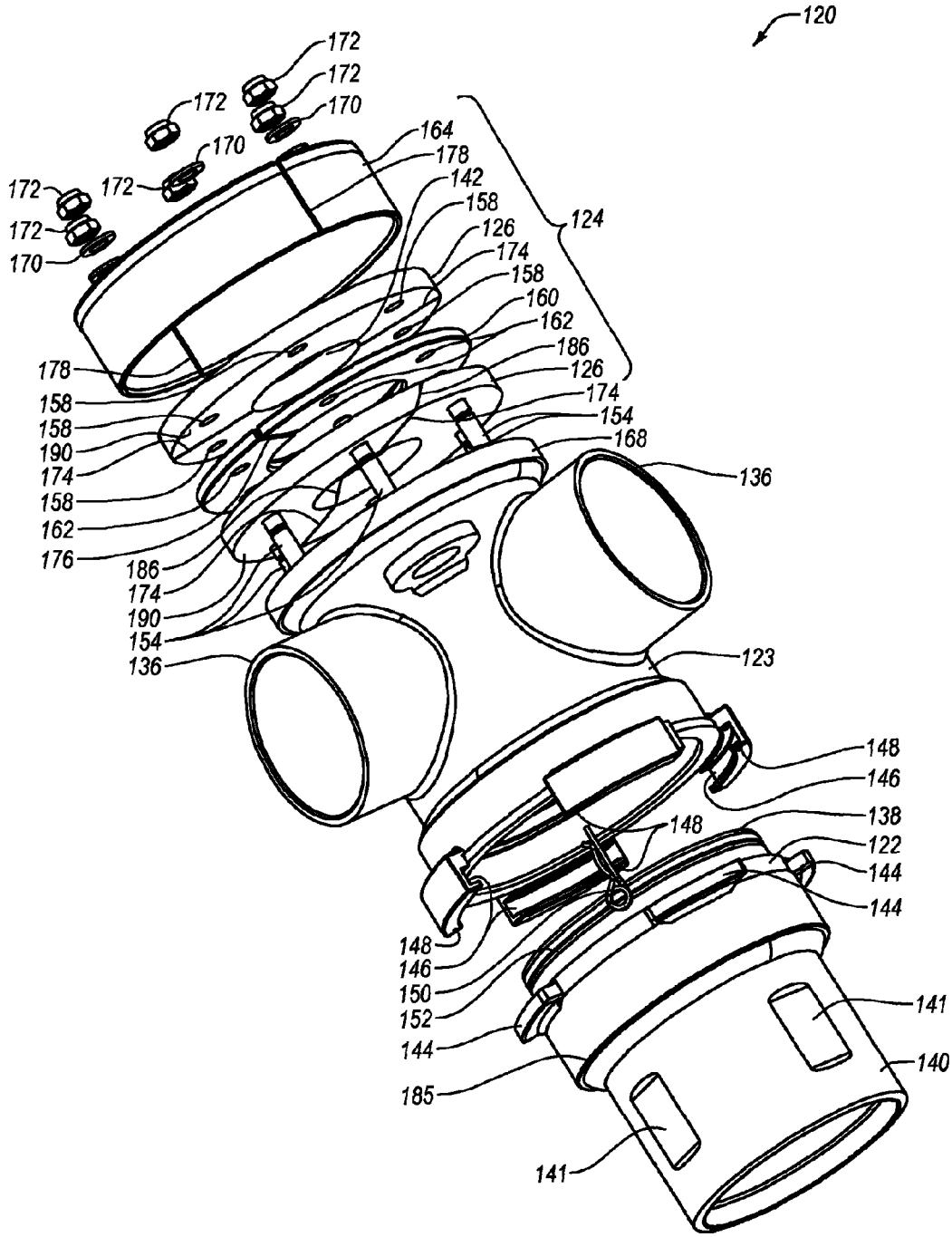
FIG. 6 is an exploded view of the conduit shown in FIG. 3.
Figure 7:
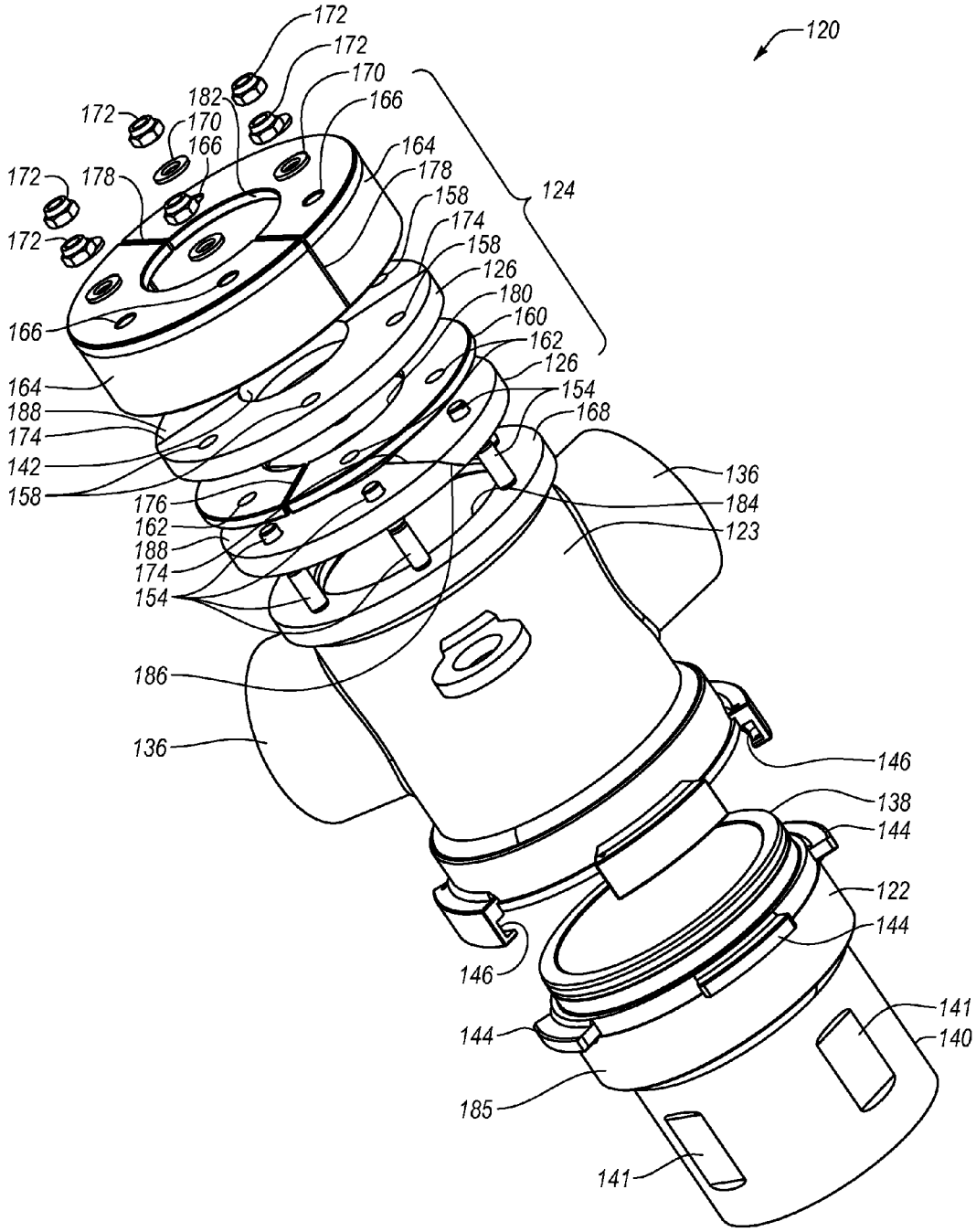
FIG. 7 is another exploded view of the conduit shown in FIG. 3.

As shown in FIGS. 6-7, the conduit 120 may have a modular construction in which the intermediate section 123 may be a separate component from the lower section 122 and/or may be a separate component from the upper section 124. For example, the intermediate section 123 of the conduit 120 may be sized and configured to be connected to and disconnected from the lower section 122 of the conduit 120. In addition, the intermediate section 123 of the conduit 120 may be sized and configured to be connected to and disconnected from the upper section 124 of the conduit 120. It will be appreciated, however, that the conduit 120 does not require any modular construction.

If the intermediate section 123 is sized and configured to be connected to and disconnected from the lower section 122, this may advantageously allow the lower section 122 of the conduit 120 to be replaced, if worn or damaged. In addition, if the lower section 122 is a separate component from the intermediate and/or upper sections 123, 124, the lower section 122 (being lighter than the conduit 120 as a whole) may be more easily connected to and/or disconnected from the outer drill string 108. After connecting the lighter lower section 122 to the outer drill string 108, the intermediate and/or upper sections 123, 124 could then be connected to the lower section 122.

Moreover, if the intermediate section 123 is sized and configured to be connected to and disconnected from the lower section 122, this may advantageously allow the intermediate section 123 to be used with a variety of different lower sections 122 that may be sized and configured to be connected to variety of different outer drill strings 108 with different types and sizes of threaded connecting portions (sometimes referred to as "thread joints") or other connection portions or "joints." For example, the different lower sections 122 may have interchangeable trailing connecting portions 138, which may be sized and configured to be interchangeably connected to and disconnected from the intermediate portion 123 of the conduit 120, but may have different leading connecting portions (or "joints") 140 with different configurations configured to be connected to and disconnected from various outer drill strings 108. In particular, the different connecting portions (or "joints") 140 may have different inner diameters and/or threads that may be configured to engage various outer drill strings 108 that have connecting portions (or "joints") having different outer diameters and/or threads with different sizes, contours, and/or configurations. To facilitate screwing threads of a lower section 122 onto and/or off of threads of an outer drill string 108, the lower section 122 may include one or more flat portions 141 shown in FIG. 6 that may be more easily gripped by a wrench or the like. It will be appreciated that the lower section 122 and the outer drill string 108 may include threads of any desired size, contour, and/or configuration to facilitate their connection. It will also be appreciated that threads are not required to connect the lower section 122 and the outer drill string 108 and that any other suitable connection means may be used.

If the intermediate section 123 is sized and configured to be connected to and disconnected from the upper section 124, this may advantageously allow the upper section 124 of the conduit 120 to be replaced, if worn or damaged. Moreover, this may advantageously allow the intermediate section 123 to be used with a variety of different upper sections 124 that may be sized and configured to form a seal with a variety of different inner drill strings 106. For instance, the different upper sections 124 may have seals 126 with openings 142 that have different inner diameters sized and configured to form a seal with and receive various inner drill strings 106 that have different outer diameters.

The lower and intermediate sections 122, 123 of the conduit 120 shown in FIGS. 6 and 7 may be sized and configured to be connected in a variety of relative orientations. The lower and intermediate sections 122, 123 may, for example, be sized and configured to be connected in a plurality of discrete relative orientations (such as, four orientations that are about ninety degrees apart) or a continuous range of relative orientations. Desirably, if the intermediate section 123 is sized and configured to be connected to and disconnected from the lower section 122 in a variety of relative orientations, this may advantageously allow the outlets 136 of the intermediate section 123 to be quickly and easily pointed in any of a variety of directions without having to move the outer drill string 108 or the lower section 122. Accordingly, the outlets 136 can be quickly and easily pointed in a direction that, for example, facilitates better placement of one or more hoses connected to the outlets 136. The outlets 136 may be disposed at oblique angles relative to the outer surface of the intermediate section 123, which may further facilitate better placement of the hoses.

Figure 3:
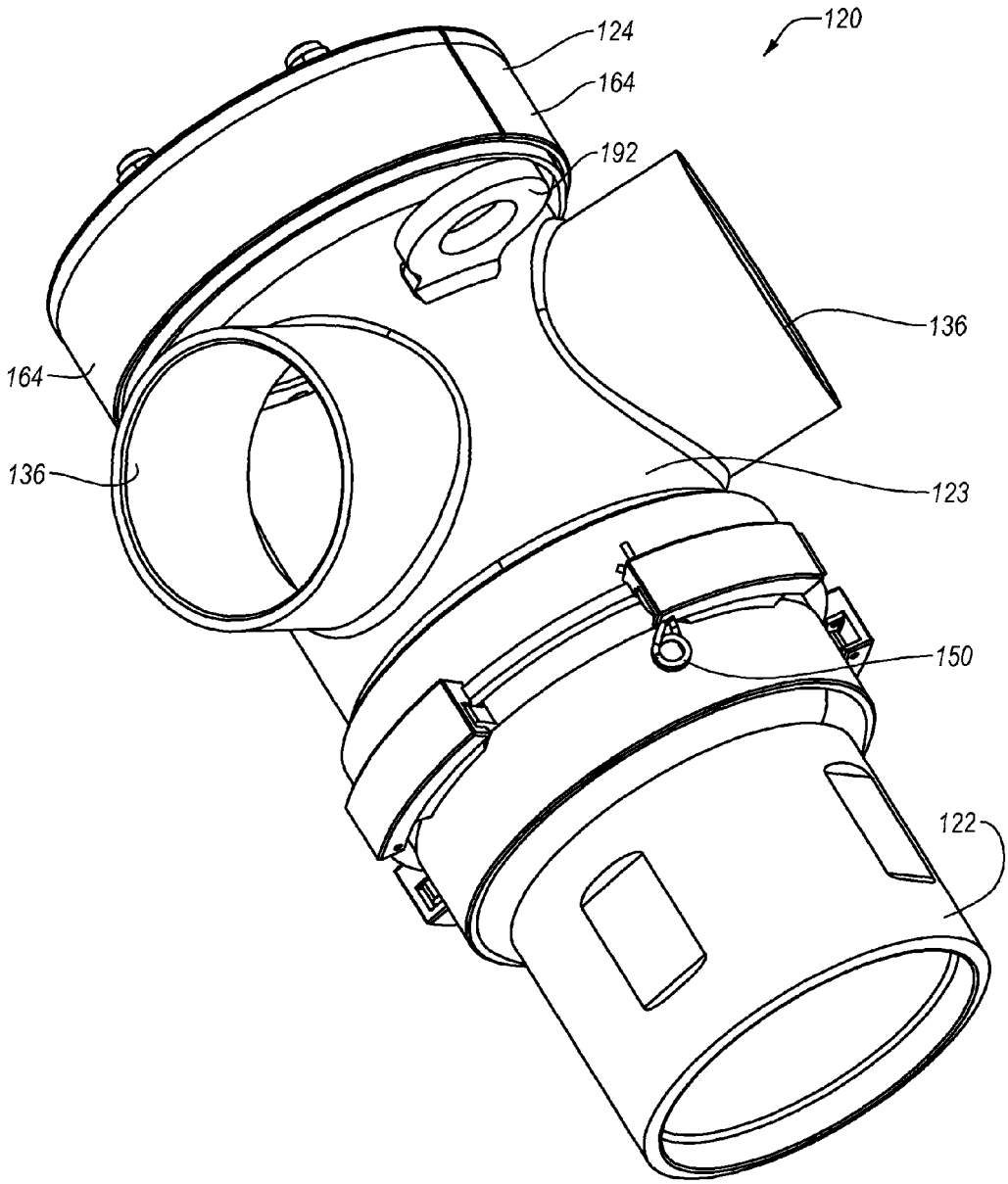
FIG. 3 is a perspective view of a portion of the drilling system shown in FIG. 1, illustrating an exemplary conduit.

To connect the lower and intermediate sections 122, 123 in the variety of relative orientations, the lower and intermediate sections 122, 123 may include one or more engaging and/or interlocking portions, such as, projections 144, recesses 146 (e.g., grooves or other recesses), threads and/or other engaging and interlocking portions. For example, the recesses 146 of the intermediate section 123 may include an open end and a closed end, and the projections 144 of the lower section 122 may be aligned with the open ends of the recesses 146. With the projections 144 aligned with the open ends of the recesses 146, the lower and intermediate sections 122, 123 may be rotated in a first relative direction such that the recesses 146 receive one or more portions of the projections 144. The lower and intermediate sections 122, 123 may include one or more openings (such as openings 148 in FIG. 6) that may be sized and configured to receive a cotter pin 150 as shown in FIG. 3 to help retain the portions of the projections 144 that are received within the recesses 146 and thus help prevent unintentional disconnection of lower and intermediate sections 122, 123. In particular, the cotter pin 150 may restrict the rotation of the lower and intermediate sections 122, 123 in an opposing second relative direction, thus retaining the portions of the projections 144 within the recesses 146 to prevent the disconnection of lower and intermediate sections 122, 123. It will be appreciated that the projections 144 and/or the recesses 146 may be formed in any or both of the lower and intermediate sections 122, 123, if desired. It will also be appreciated that the projections 144 and the recesses 146 are not required and that the lower and intermediate sections 122, 123 may be connected using any other suitable means.

As shown in FIG. 6, the conduit 120 may include an o-ring 152. The o-ring 152 may help provide a seal between the lower and intermediate sections 122, 123 when connected.

As shown in FIGS. 6 and 7, one or more fasteners 154 (such as, stud bolts and/or other fasteners) may be used to connect the intermediate and upper sections 123, 124 of the conduit 120. In particular, the upper section 124 may include one or more components that may include one or more openings sized and configured to receive the fasteners 154 to connect the intermediate and upper sections 123, 124. For example, to connect the intermediate and upper sections 123, 124, the upper section 124 of the conduit 120 may include one or more seals 126 that may include one or more openings 158 sized and configured to receive the fasteners 154, a thrust plate 160 that may include one or more openings 162 sized and configured to receive the fasteners 154, and/or a housing 164 that may include one or more openings 166 sized and configured to receive the fasteners 154.

The fasteners 154 may be connected to a thrust plate 168 of the intermediate section 123 of the conduit 120. With the fasteners 154 inserted through the openings 158, 162, 166 of the components of the upper section 124, washers 170 and nuts 172 may be connected to the fasteners 154 to secure the components of the upper section 124 to the thrust plate 168 of the intermediate section 123.

Figure 4:
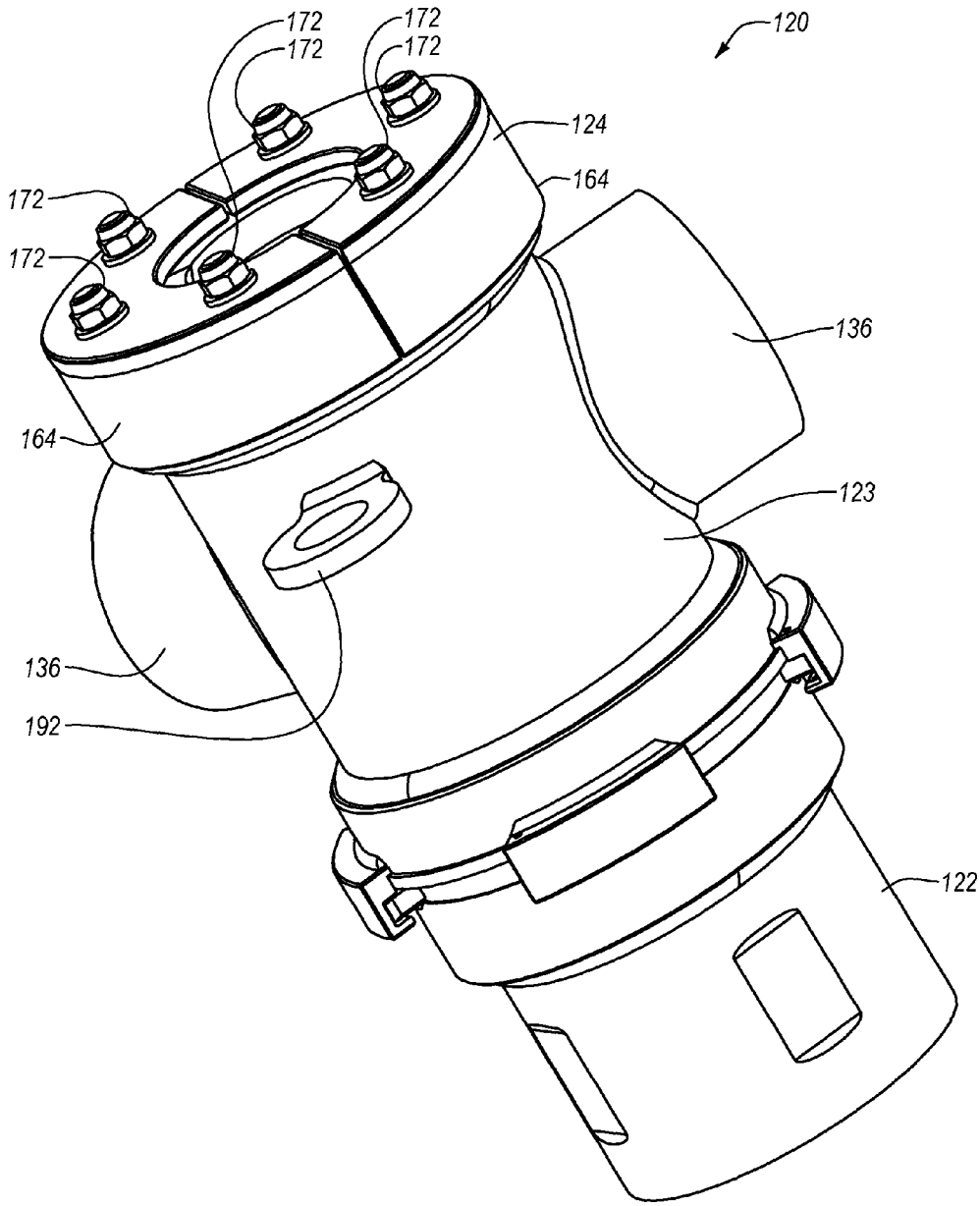
FIG. 4 is a perspective view of the conduit shown in FIG. 3.
Figure 5:
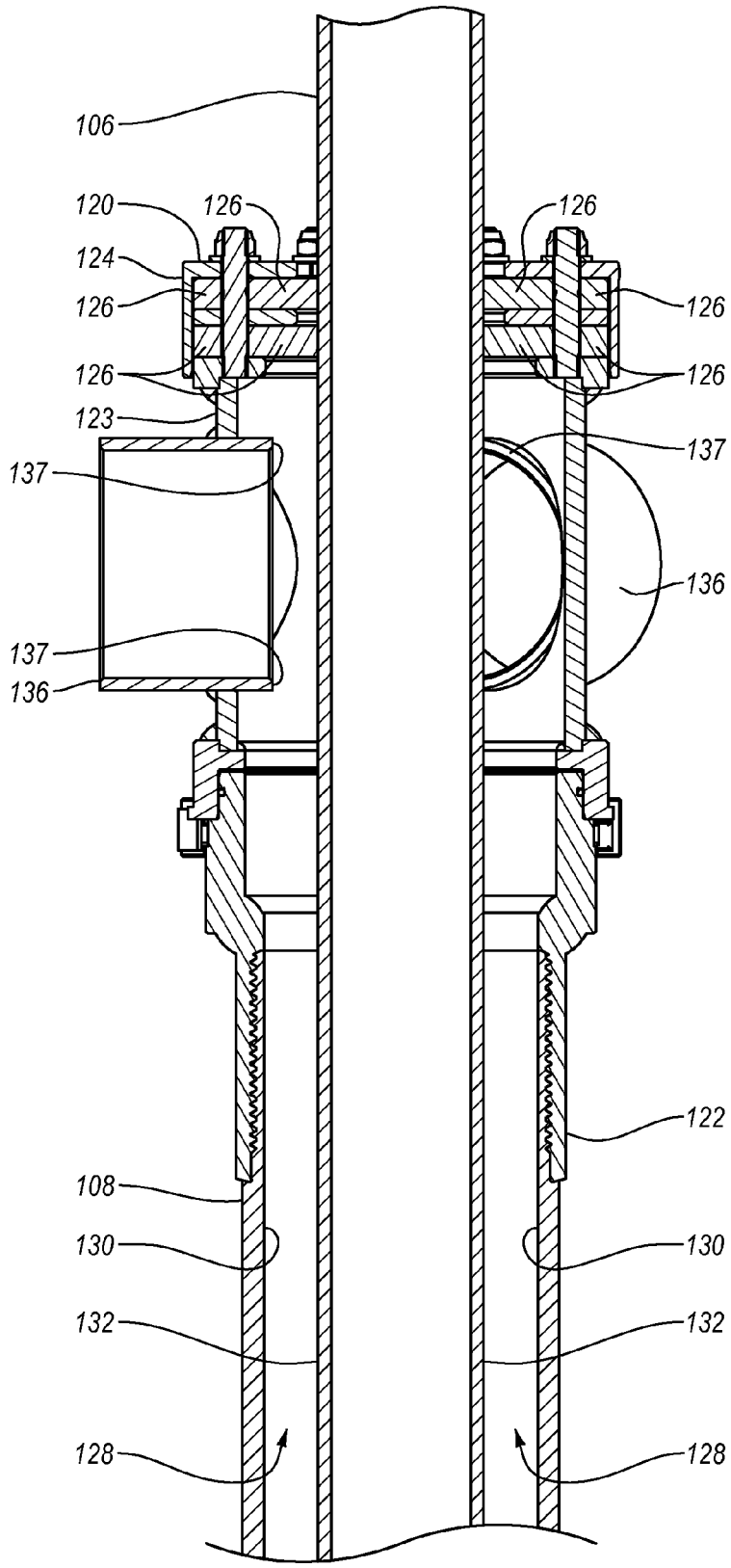
FIG. 5 is a cross-sectional view of a portion of the drilling system shown in FIG. 1.

As shown in FIG. 4, when the intermediate and upper sections 123, 124 are connected, the housing 164 of the upper section 124 may house at least a portion of one or more components of the upper section 124 and/or at least a portion of one or more components of the intermediate section 123. For example, the housing 164 may house at least a portion of one or more of the seals 126, at least a portion of the thrust plate 160 of the upper section 124, and/or at least a portion of the thrust plate 168 of the intermediate section 123.

As shown in FIG. 7, one or more of the seals 126, the thrust plate 160, and/or the housing 164 may include one or more slits 174, 176, 178 and a central opening 142, 180, 182 sized and configured to receive a portion of the inner drill string 106. The slits 174, 176, 178 may extend from an outer edge of these components to the central opening 142, 180, 182. This may allow the seals 126, the thrust plate 160, and/or the housing 164 to be quickly and easily connected to and/or disconnected from the intermediate section 123 and the inner drill string 106, while the inner drill 106 extends through the conduit 120 and/or remains connected to the driving mechanism 118. Consequently, the slits 174, 176, 178 may advantageously allow the seals 126, the thrust plate 160, and/or the housing 164 to be replaced if worn or damaged without having to disconnect the inner drill string 106 from the driving mechanism 118 and without having to disconnect the entire conduit 120 from the outer drill string 108. Moreover, with the seals 126, the thrust plate 160, and the housing 164 disconnected from the intermediate section 123 and the inner drill string 106, the drill bit 110 of the inner drill string 106 may advantageously be retrieved through an opening 184 in the thrust plate 168 without having to disconnect the inner drill string 106 from the driving mechanism 118 and without having to disconnect the entire conduit 120 from the outer drill string 108. The retrieved drill bit 110 may then be easily cleaned (if clogged) or replaced (if worn or damaged). The slits 174, 176, 178 may be particularly advantageous where the drill bit 110 is significantly larger than the central openings 142, 180, 182, such that the drill bit 110 could not be retrieved through the central openings 142, 180, 182 for cleaning or replacement.

Significantly, because the inner drill string 106 need not be disconnected from the driving mechanism 118 and the entire conduit 120 need not be disconnected from the outer drill string 108, this may save a substantial amount of time and money when replacing or cleaning the seals 126, the thrust plate 160, the housing 164 and/or the drill bit 110. Moreover, because the inner drill string 106 need not be disconnected from the driving mechanism 118 and the entire conduit 120 need not be disconnected from the outer drill string 108, this may prevent inadvertent loss of the drill strings 106, 108 down the borehole 104 because the inner drill string 106 may remain connected to the driving mechanism 118 and a clamp may continue to engage an enlarged portion 185 of the lower section 122 of the conduit 120 while connected to the outer drill string 108.

The one or more slits 174 of the seals 126 may form one or more seams 186 that may extend at an oblique angle relative to an upper face 188 (FIG. 7) and a lower face 190 (FIG. 6) of the seals 126. The oblique angle of the seams 186 may, for example, be between about thirty degrees to about sixty degrees, between about forty degrees to about fifty degrees, about forty-five degrees, or other desired oblique angle relative to the upper and/or lower faces 188, 190 of the seals 126. Desirably, with the seams 186 extending at the oblique angle relative to the upper and lower faces 188, 190, portions of the seals 126 that abut each other at the seams 186 may axially overlap to provide a better seal. It will be appreciated, however, that the seams 186 need not extend at an oblique angle relative to the upper and lower faces 188, 190 and may, if desired, be perpendicular to the upper and lower faces 188, 190. It will be appreciated that the portions of the seals 126 that abut each other at the seams 186 need not axially overlap.

As shown in FIGS. 6 and 7, the seals 126, the thrust plate 160, and the housing 164 may be connected to the intermediate section 123, such that the slits 174, 176, 178 of one component are offset from the slits 174, 176, 178 of an adjacent component. Desirably, if the slits 174, 176, 178 of one component are offset from the slits 174, 176, 178 of an adjacent component, this may provide better sealing.

In further detail, the openings 158, 162, 166 of the seals 126, the thrust plate 160, and the housing 164 may be arranged to allow the seals 126, the thrust plate 160, and the housing 164 to be connected to the fasteners 154 of the intermediate section 123 in a plurality of different orientations. Accordingly, the slits 174 of a first seal 126 may be offset from the slits 176 of an adjacent thrust plate 160. The slits 176 of the thrust plate 160 may be offset from the slits 174 of an adjacent second seal 126. The slits 174 of the second seal 126 may be offset from the slits 178 of the adjacent housing 164. If desired, the slits 174 of the second seal 126 may also be offset from the slits 174 of the first seal 126. In one example, the openings 158, 162, 166 may be arranged to allow the seals 126, the thrust plate 160, and the housing 164 to be connected to the fasteners 154 in a plurality of different orientations that are about sixty degrees offset from each other. This may allow the slits 174, 176, 178 of one component to be about sixty degrees offset from the slits of an adjacent component.

As shown in FIGS. 6 and 7, the seals 126, the thrust plate 160, and the housing 164 may include a pair of slits 174, 176, 178 that may divide the seals 126, the thrust plate 160, and the housing 164 into a pair of half-sections. If desired, however, the seals 126, the thrust plate 160, and the housing 164 may have a single slit 174, 176, 178 or more than two slits 174, 176, 178. Moreover, it will be appreciated that the seals 126, the thrust plate 160, and the housing 164 do not require any slits 174, 176, 178 and that the seals 126, the thrust plate 160, and the housing 164 may have a unitary, one-piece construction.

As discussed above, the housing 164 of the upper section 124 may house at least a portion of one or more components of the upper section 124, such as one or more of the seals 126. If desired, the housing 164 may include an inner surface that may abut the outer edge of a seal 126 such that, if the seal is axially compressed, a radial force may increase a strength of a seal formed between the inner drill string 106 and the opening 142 in the seal 126. For example, when the nuts 172 are tightened on the fasteners 154, a first seal 126 may be axially compressed by and between the thrust plate 160 and the thrust plate 168, and a second seal 126 may be axially compressed by and between the thrust plate 160 and the housing 164. Desirably, if the housing 164 abuts the outer edges of the first and second seals 126, this axial compression may cause a radial force that pushes portions of the first and second seals 126 inwardly towards the inner drill string 106, which may increase the strength of the seals formed between the inner drill string 106 and the openings 142 of the first and second seals 126.

The openings 180, 182, 184 in the thrust plate 160, the housing 164, and the thrust plate 168 may include chamfered edges. The chamfered edges may be sized and configured to receive portions of the seals 126 that are displaced when forming a seal with the inner drill string 106.

As shown in FIGS. 3 and 4, the intermediate section 123 of the conduit 120 may include one or more rings 192 that may be used as handles for lifting the conduit 120 and/or may be connected to tethers (such as chains) to secure the conduit 120.

If desired, one or more components of the lower, intermediate, and upper sections 122, 123, 124 of the conduit 120 may be constructed from a relatively strong and/or durable material, such as metal. For example, the outlets 136; the projections 144; the recesses 146; the fasteners 154; the thrust plates 160, 168; the housing 164; and/or any other desired portion of the lower, intermediate, and upper sections 122, 123, 124 may be constructed from metal. It will be appreciated, however, that these components need not be constructed from metal and may be constructed from other materials having other characteristics.

If desired, one or more components of the lower, intermediate, and upper sections 122, 123, 124 of the conduit 120 may be constructed from a relatively elastic material, such as rubber. For example, the seals 126, the o-ring 152, and/or any other desired portion of the lower, intermediate, and upper sections 122, 123, 124 may be constructed from rubber. It will be appreciated, however, that these components need not be constructed from rubber and may be constructed from other materials having other characteristics.

The methods and systems described above require no particular component or function. Thus, any described component or function—despite its advantages—is optional. Also, some or all of the described components and functions described above may be used in connection with any number of other suitable components and functions.

One skilled in the art will also appreciate that although the exemplary embodiments discussed above have been described with respect to cased drilling systems, these aspects and features may also be used in connection with other types of drilling systems.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A conduit assembly for use in a drilling system, the conduit assembly comprising:

an upper section including a first seal, the first seal including an opening sized and configured to receive and form a seal with an inner drill string;

an intermediate section including an outlet for a flushing medium; and a first lower section sized and configured to be connected to and disconnected from the intermediate section, the first lower section including a leading portion sized and configured to be connected to and disconnected from a connecting portion of a first outer drill string, the first lower section further including an enlarged portion sized and configured to engage a clamp when the first lower section is connected to the first outer drill string to prevent a loss of the first outer drill string down a borehole.

2. The conduit assembly as in claim 1, wherein the first lower section is sized and configured to be connected to the intermediate section in four discrete relative orientations that are about ninety degrees apart.

3. The conduit assembly as in claim 1, wherein the first lower section is sized and configured to be connected to the intermediate section in a plurality of discrete relative orientations.

4. The conduit assembly as in claim 1, wherein the first lower section is sized and configured to be connected to the intermediate section in a continuous range of orientations.

5. The conduit assembly as in claim 1, further comprising:

projections formed in the first lower section; and recesses formed in the intermediate section, the recesses being sized and configured to receive one or more portions of the projections to connect the first lower section to the intermediate section.

6. The conduit assembly as in claim 5, further comprising:

one or more pins configured to retain the one or more portions of the projections of the first lower section within the recesses of the intermediate section.

7. The conduit assembly as in claim 1, further comprising:

projections formed in the intermediate section; and recesses formed in the first lower section, the recesses being sized and configured to receive one or more portions of the projections to connect the first lower section to the intermediate section.

8. The conduit assembly as in claim 7, further comprising:

one or more pins configured to retain the one or more portions of the projections of the intermediate section within the recesses of the first lower section.

9. The conduit assembly as in claim 1, further comprising:

a second lower section sized and configured to be connected to and disconnected from the intermediate section, the second lower section including a leading portion sized and configured to be connected to and disconnected from a connecting portion of a second outer drill string;

wherein the leading portion of the first lower section includes one or more threads sized and configured to engage one or more threads formed in the connecting portion of the first outer drill string;

wherein the leading portion of the second lower section includes one or more threads sized and configured to engage one or more threads formed in the connecting portion of the second outer drill string; and wherein the one or more threads formed in the connecting portion of the first outer drill string have a first size; and wherein the one or more threads formed in the connecting portion of the second outer drill string have a different, second size.

10. The conduit assembly as in claim 1, further comprising:

a second lower section sized and configured to be connected to and disconnected from the intermediate section, the second lower section including a leading portion sized and configured to be connected to and disconnected from a connecting portion of a second outer drill string;

wherein the leading portion of the first lower section includes one or more threads sized and configured to engage one or more threads formed in the connecting portion of the first outer drill string;

wherein the leading portion of the second lower section includes one or more threads sized and configured to engage one or more threads formed in the connecting portion of the second outer drill string; and wherein the one or more threads formed in the connecting portion of the first outer drill string have a first configuration; and wherein the one or more threads formed in the connecting portion of the second outer drill string have a different, second configuration.

11. The conduit assembly as in claim 1, further comprising:

a second lower section sized and configured to be connected to and disconnected from the intermediate section, the second lower section including a leading portion sized and configured to be connected to and disconnected from a connecting portion of a second outer drill string;

wherein the connecting portion of the first outer drill string has a first outer diameter; and wherein the connecting portion of the second outer drill string has a different, second outer diameter.

12. A conduit assembly for use in a drilling system, the conduit assembly comprising:

an upper portion including a first seal, the first seal including:

an outer edge;

an opening sized and configured to receive and form a seal with an inner drill string; and at least one slit extending from the outer edge of the first seal to the opening of the first seal;

an intermediate portion including an outlet for a flushing medium; and a lower portion sized and configured to be connected to and disconnected from a connecting portion of an outer drill string, wherein the lower portion of the conduit assembly is sized and configured to engage a clamp when the lower portion of the conduit assembly is connected to the outer drill string to prevent a loss of the outer drill string down a borehole.

13. The conduit assembly as in claim 12, wherein the at least one slit forms a seam;

and wherein portions of the first seal that abut each other at the seam axially overlap.

14. The conduit assembly as in claim 12, wherein the at least one slit forms a seam that extends at an oblique angle relative to an upper face of the first seal.

15. The conduit assembly as in claim 12, wherein the at least one slit forms a seam that extends at an angle relative to an upper face of the first seal that is between thirty degrees to sixty degrees.

16. The conduit assembly as in claim 12, wherein the at least one slit forms a seam that extends at an angle relative to an upper face of the first seal that is between forty degrees to fifty degrees.

17. The conduit assembly as in claim 12, wherein the at least one slit forms a seam that extends at an angle relative to an upper face of the first seal that is about 45 degrees.

18. The conduit assembly as in claim 12, wherein the at least one slit forms a seam that extends at an oblique angle relative to a lower face of the first seal.

19. The conduit assembly as in claim 12, wherein the at least one slit forms a seam that extends at an angle relative to a lower face of the first seal that is between thirty degrees to sixty degrees.

20. The conduit assembly as in claim 12, wherein the at least one slit forms a seam that extends at an angle relative to a lower face of the first seal that is between forty degrees to fifty degrees.

21. The conduit assembly as in claim 12, wherein the at least one slit forms a seam that extends at an angle relative to a lower face of the first seal that is about 45 degrees.

22. The conduit assembly as in claim 12, wherein the at least one slit comprises:

a plurality of slits extending from the outer edge of the first seal to the opening of the first seal.

23. The conduit assembly as in claim 22, wherein the upper portion further comprises a thrust plate adjacent the first seal, the thrust plate including:

an outer edge;

an opening sized and configured to receive the inner drill string; and a plurality of slits extending from the outer edge of the thrust plate to the opening of the thrust plate.

24. The conduit assembly as in claim 23, wherein the slits of the first seal are offset from the slits of the thrust plate.

25. The conduit assembly as in claim 23, wherein the upper portion further comprises a second seal adjacent the thrust plate, the second seal including:

an outer edge;

an opening sized and configured to receive and form a seal with the inner drill string; and a plurality of slits extending from the outer edge of the second seal to the opening of the second seal.

26. The conduit assembly as in claim 25, wherein the slits of the first seal are offset from the slits of the thrust plate; and wherein the slits of the second seal are offset from the slits of the thrust plate.

27. The conduit assembly as in claim 25, wherein the slits of the first seal are offset from the slits of the thrust plate; wherein the slits of the second seal are offset from the slits of the thrust plate; and wherein the slits of the second seal are offset from the slits of the first seal.

28. The conduit assembly as in claim 25, wherein the upper portion further comprises a housing that houses at least a portion of the first seal, at least a portion of the thrust plate, and at least a portion of the second seal, the housing including:

an outer edge;

an opening sized and configured to receive the inner drill string; and a plurality of slits extending from the outer edge of the housing to the opening of the housing.

29. The conduit assembly as in claim 28, wherein the slits of the first seal are offset from the slits of the thrust plate; wherein the slits of the second seal are offset from the slits of the thrust plate; and wherein the slits of the housing are offset from the slits of the second seal.

30. A conduit assembly for use in a drilling system, the conduit assembly comprising:

an upper portion including a first seal, the first seal including an opening sized and configured to receive and form a seal with an inner drill string;

an intermediate portion including:

a hollow interior;

an outer surface;

an inner surface; and an outlet for a flushing medium, the outlet including a projection that extends into the hollow interior beyond the interior surface; and a lower portion sized and configured to be connected to and disconnected from a connecting portion of an outer drill string, wherein the projection that extends into the hollow interior beyond the interior surface is sized and configured to break up portions of the flushing medium and debris conveyed by the flushing media.

31. The conduit assembly as in claim 30, wherein the projection that extends into the hollow interior beyond the interior surface comprises a tube that extends into the hollow interior beyond the interior surface.

32. The conduit assembly as in claim 30, wherein the outlet is disposed at an oblique angle relative to the outer surface.

33. A conduit assembly for use in a drilling system, the conduit assembly comprising:

an upper portion including:

a first seal including:

an outer edge; and an opening sized and configured to receive and form a seal with an inner drill string; and a housing that houses at least a portion of the first seal, the housing including:

an inner surface that abuts the outer edge of the first seal such that, when the first seal is axially compressed, a radial force increases a strength of the seal formed between the inner drill string and the opening in the first seal;

an intermediate portion including an outlet for a flushing medium; and a lower portion sized and configured to be connected to and disconnected from a connecting portion of an outer drill string.

34. The conduit assembly as in claim 33, wherein the upper portion of the conduit assembly further includes a first thrust plate;

wherein the intermediate portion of the conduit assembly further comprises a second thrust plate; and wherein the first seal is axially compressed between the first and second thrust plates to create the radial force that increases the strength of the seal formed between the inner drill string and the opening in the first seal.

35. The conduit assembly as in claim 33, wherein the upper portion of the conduit assembly further includes a thrust plate; and wherein the first seal is axially compressed between the thrust plate and the housing to create the radial force that increases the strength of the seal formed between the inner drill string and the opening in the first seal.

36. The conduit assembly as in claim 33, wherein the first seal is axially compressed between a component of the upper portion of the conduit assembly and a component of the intermediate portion of the conduit assembly to create the radial force that increases the strength of the seal formed between the inner drill string and the opening in the first seal.

* * * * *